United States Patent [19]

Kaneko et al.

[11] Patent Number: 4,735,181

[45] Date of Patent: Apr. 5, 1988

[54] THROTTLE VALVE CONTROL SYSTEM OF INTERNAL COMBUSTION ENGINE

[75] Inventors: Tadashi Kaneko; Itaru Okuno, both of Hiroshima; Nagahisa Fujita, Aki, all of Japan

[73] Assignee: Mazda Motor Corporation, Hiroshima, Japan

[21] Appl. No.: 42,345

[22] Filed: Apr. 24, 1987

[30] Foreign Application Priority Data

Apr. 28, 1986 [JP] Japan ..... 61-98879

[51] Int. Cl.[4] ..... F02D 41/10

[52] U.S. Cl. ..... 123/361; 123/399

[58] Field of Search ..... 123/352, 361, 399, 492

[56] References Cited

U.S. PATENT DOCUMENTS

| | | | |
|---|---|---|---|
| 4,367,805 | 1/1983 | Totani et al. | 123/361 |
| 4,385,604 | 5/1983 | Fiala | 123/399 |
| 4,453,516 | 6/1984 | Filsinger | 123/399 |
| 4,471,610 | 9/1984 | Watanabe | 123/399 |
| 4,508,078 | 4/1985 | Takeuchi et al. | 123/399 |
| 4,526,153 | 7/1985 | Hasegawa et al. | 123/492 |
| 4,589,302 | 5/1986 | Oda et al. | 74/866 |
| 4,671,235 | 6/1987 | Hosaka | 123/399 |

FOREIGN PATENT DOCUMENTS

| | | |
|---|---|---|
| 56-14834 | 2/1981 | Japan . |
| 59-10749 | 1/1984 | Japan . |
| 59-10750 | 1/1984 | Japan . |
| 59-10752 | 1/1984 | Japan . |
| 59-10753 | 2/1984 | Japan . |
| 61-83461 | 4/1986 | Japan . |

*Primary Examiner*—William A. Cuchlinski, Jr.
*Attorney, Agent, or Firm*—Fleit, Jacobson, Cohn & Price

[57] ABSTRACT

An internal combustion engine throttle valve control system comprising driving means for driving a throttle valve so that the opening of the throttle valve assumes a predetermined value, engine r.p.m. detecting means for detecting engine r.p.m., and control means for controlling the rate of driving the throttle valve which receive the output signal from the engine r.p.m. detecting means and which produces, in accordance with the rate of change in the position of the accelerator pedal, a first signal to drive the throttle valve at a first rate corresponding to the rate of change in the position of the accelerator pedal under a condition where the amount of change in the position of the accelerator pedal is not larger than a predetermined value and a second signal to drive the throttle valve at a second rate smaller than the first rate under the condition where the amount of change in the position of the accelerator pedal is larger than the predetermined value and where the rate of change in the position of the accelerator pedal is larger than a predetermined value and where the engine r.p.m. is smaller than a predetermined value and controls said driving means in accordance with the engine operating condition. According to the present invention, the response of the engine to acceleration under high engine r.p.m. can be remarkably improved and knocking can be effectively prevented under low engine r.p.m. without degrading the response of the engine to acceleration when an accelerator pedal is slightly operated.

11 Claims, 8 Drawing Sheets

THROTTLE VALVE CONTROL SYSTEM OF INTERNAL COMBUSTION ENGINE

BACKGROUND OF THE INVENTION

The present invention relates to a internal combustion engines throttle valve control system of vehicles, and more particularly to such control system for controlling the opening of a throttle valve in accordance with change in position of an accelerator pedal.

DESCRIPTION OF PRIOR ART

As disclosed in unexamined Japanese Patent Publication No. 14834/1981, there is known a throttle valve control system in which there are provided a means for driving a throttle valve in accordance with change in position of an accelerator pedal at a rate corresponding to the rate of change in the position of the accelerator pedal so that the degree of opening of the throttle valve is such as to feed a predetermined amount of intake air into an internal combustion engine, whereby the engine exhibits improved response characteristics during acceleration.

However, in this prior art system, since during acceleration the amount of opening of the throttle valve is changed to a predetermined value at a rate corresponding to the rate of change in the position of the accelerator pedal regardless of engine r.p.m., the amount of intake air and the engine load considerably change under low engine r.p.m. operating conditin so that the air-fuel ratio becomes lean and the ignition timing advances excessively. As a result, engine response to operation of the accelerator pedal cannot be improved and knocking often arises. In a case where the rate of change in the position of the throttle valve is set lower in order to solve this problem, there inevitably arises another problem that engine response to the operation of the accelerator pedal becomes worse under high engine r.p.m. operating condition and that it becomes very difficult to accelerate quickly under high speed operating condition.

One of the solutions for the above described problems is to employ means for decreasing the rate of change in the position of the throttle valve under low engine r.p.m. operating conditions as compared with that under high engine r.p.m. operating condition.

However, even if such means is employed, if the rate of change in the position of the throttle valve is controlled in accordance with only the rate of change in the position of the accelerator pedal and the engine r.p.m. regardless of the amount of change of the position of the accelerator pedal, the rate of change in the position of the throttle valve is inevitably set small to make the response of the engine to operation of the accelerator pedal worse in the case where the amount of change in the position of the accelerator pedal is small during low engine r.p.m. since if the amount of change in the position of the accelerator pedal is small, the amount of intake air does not change so much and the air-fuel ratio does not become so lean, even if the throttle valve is moved rapidly during the low engine r.p.m.

SUMMARY OF THE INVENTION

It is therefore an object of the present invention to provide an internal combustion engine throttle valve control system of vehicles wherein response to the operation of an accelerator pedal for acceleration is improved without degrading the response to small changes in the position of the accelerator pedal.

According to the present invention, the above and other objects can be accomplished by an internal combustion engine throttle valve control system comprising driving means for driving a throttle valve so that the opening of the throttle valve assumes a predetermined value in accordance with the amount of change in the position of an accelerator pedal, engine r.p.m. detecting means for detecting engine r.p.m. and outputting a signal representing the detected engine r.p.m., and control means for controlling the rate of driving the throttle valve which receives said signal output from said engine r.p.m. detecting means and which produces, in accordance with the rate of change in the position of the accelerator pedal, a first signal to drive the throttle valve at a first rate corresponding to the rate of change in the position of the accelerator pedal under a condition where the amount of change in the position of the accelerator pedal is not larger than a predetermined value and a second signal to drive the throttle valve at a second rate smaller than the first rate under the condition where the amount of change in the position of the accelerator pedal is larger than the predetermined value and where the rate of change in the position of the accelerator pedal is larger than a predetermined value and where the engine r.p.m. is smaller than a predetermined value and controls said driving means in accordance with the engine operating condition.

In a preferred aspect of the present invention, an internal combustion engine throttle valve control system comprises accelerator pedal operation detecting means for detecting the amount of change in the position of an accelerator pedal and outputting a signal based upon said detected amount of change in the position of the accelerator pedal, throttle opening determining means for receiving said signal output from said accelerator pedal operation detecting means and determining an opening of the throttle valve corresponding the amount of change in the position of the accelerator pedal based upon said received signal and outputting a signal representing said opening of the throttle valve, driving means for receiving said signal outputted from said throttle valve opening determining means and driving the throttle valve so that its opening becomes said determined opening value, engine r.p.m. detecting means for detecting engine r.p.m. and outputting a signal based upon said detected engine r.p.m., accelerator pedal operation rate detecting means for detecting the rate of change in the position of the accelerator pedal for acceleration and outputting a signal based upon the detected rate of change in the position of the accelerator pedal, and control means for controlling the rate of driving the throttle valve which receives said signal output from said engine r.p.m. detecting means and which produces, in accordance with the rate of change in the position of the accelerator pedal, a first signal to drive the throttle valve at a first rate corresponding to the rate of change in the position of the accelerator pedal under a condition where the amount of change in the position of the accelerator pedal is not larger than a predetermined value and a second signal to drive the throttle valve at a second rate smaller than the first rate under the condition where the amount of change in the position of the accelerator pedal is larger than the predetermined value and where the rate of change in the position of the accelerator pedal is larger than a predetermined value and where the engine r.p.m. is smaller than a predetermined engine r.p.m. and controls said driving means in accordance with the engine operating condition.

In another preferred aspect of the present invention, an internal combustion engine throttle valve control system comprises accelerator pedal operation detecting means for detecting the amount of change in the position of an accelerator pedal and outputting a signal based upon said detected amount of change in the position of the accelerator pedal, throttle valve opening determining means for receiving said signal output from said accelerator pedal operation detecting means and determining an opening of the throttle valve corresponding the amount of change in the position of the accelerator pedal based upon said received signal and outputting a signal representing said opening of the throttle valve, driving means for receiving said signal output from said throttle valve opening determining means and driving the throttle valve so that its opening assumes said determined opening value, engine r.p.m. detecting means for detecting engine r.p.m. and outputting a signal representing said detected engine r.p.m., accelerator pedal operation rate detecting means for detecting the rate of change in the position of the accelerator pedal for acceleration and outputting a signal based upon the detected rate of change in the position of the accelerator pedal, and control means for controlling a rate of driving the throttle valve which receives said signal output from said engine r.p.m. detecting means and which produces a first signal to drive the throttle valve at a first rate corresponding to the rate of change of the position of the accelerator pedal under a condition where the amount of change in the position of the accelerator pedal is not larger than a predetermined value and, under the condition where the amount of change in the position of the accelerator pedal is larger than the predetermined value, a second signal to drive the throttle valve at a second rate which is not larger than the first rate and which is determined in accordance with the engine r.p.m. to be smaller in proportion as the engine r.p.m. is lower, and outputs either of the first or second signal to said driving means in accordance with the engine operating condition.

The above and other objects and features of the present invention will become apparent from the following description made with reference to the accompanying drawings.

DESCRIPTION OF THE PREFERRED EMBODIMENTS

Figure 1:
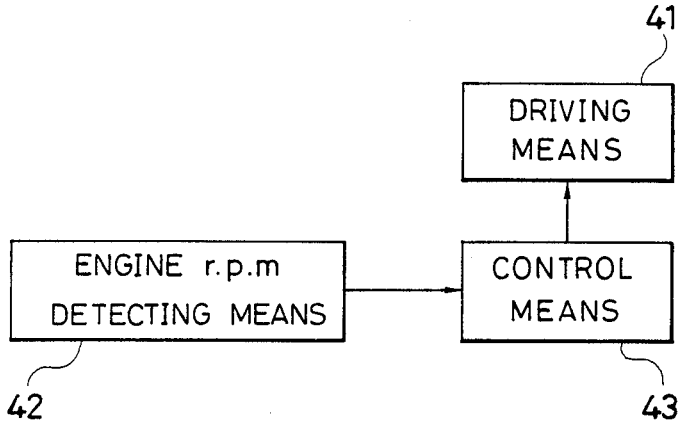
FIG. 1 is a block diagram showing a basic structure of an internal combustion engine throttle valve control system of the present invention.

FIG. 1 shows the basic structure of a throttle valve control system of the present invention. Referring to FIG. 1, the throttle valve control system comprises driving means 41 for driving a throttle valve so that the opening of the throttle valve can be set at a predetermined value in accordance with the amount of change in the position of an accelerator pedal, engine r.p.m. detecting means 42 for detecting engine r.p.m. and outputting a signal obtained based upon the detected engine r.p.m. and control means 42 for controlling the rate of driving the throttle valve which receives said signal output from said engine r.p.m. detecting means 41 and which produces, in accordance with the rate of change in the position of the accelerator pedal, a first signal to drive the throttle valve at a first rate corresponding to the rate of change in the position of the accelerator pedal under a condition where the amount of change of the position of the accelerator pedal is not larger than a predetermined value and a second signal to drive the throttle valve at a second rate smaller than the first rate under the condition where the amount of change in the position of the accelerator pedal is larger than the predetermined value and where the rate of change in the position of the accelerator pedal is larger than a predetermined value and where the engine r.p.m. is smaller than a predetermined engine r.p.m. and controls said driving means 41 in accordance with the engine operating condition.

Figure 2:
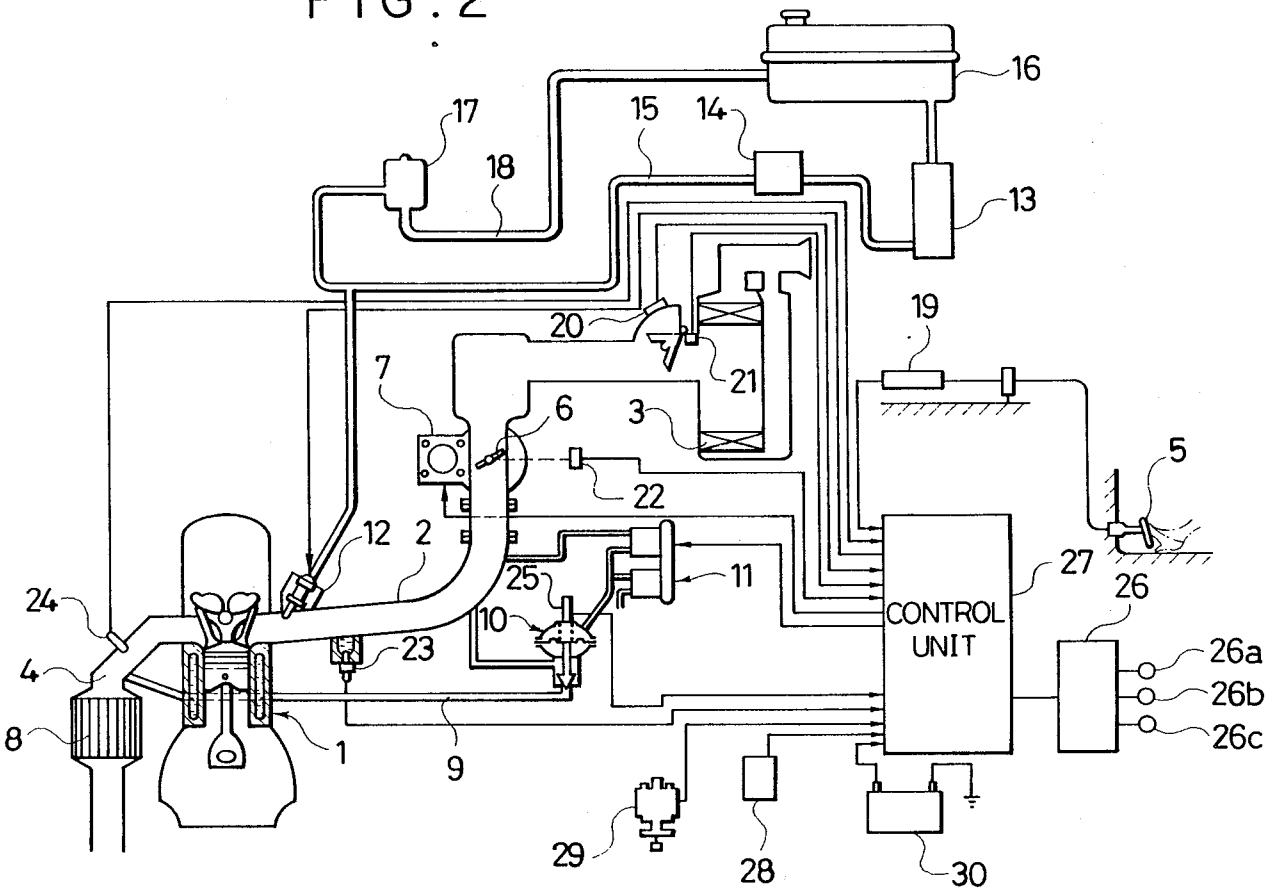
FIG. 2 is a schematic drawing showing an internal combustion engine including a control apparatus for a throttle valve which is an embodiment of the present invention.

Referring to FIG. 2, there is shown an internal combustion engine system including a throttle valve control system which is an embodiment of the present invention. The system includes the engine 1 and an intake passage 2 which opens to the engine 1 at one end thereof and is communicated with the atmosphere through an air cleaner 3 provided at the other end thereof to feed intake air into the engine 1, and an exhaust passage 4 which opens to the engine 1 at one end thereof and is communicated with the atmosphere to discharge exhaust gas from the engine 1. Further, there are provided an accelerator pedal 5 operated by the operator in accordance with the output of the engine 1 required and a throttle valve 6 in the intake passage 2 for controlling the amount of intake air. The opening of the throttle valve 6 is controlled by a throttle actuator 7 comprising a step motor based upon an electrical signal representing the position level of the accelerator pedal 5. The reference numeral 8 designates a catalyst device disposed in the exhaust passage 4 for purifying the exhaust gas and the reference numeral 9 designates an exhaust gas recirculating passage one end of which opens to an upstream portion of the catalyst device 8 in the exhaust passage 4 and the other end of which opens to a downstream portion of the throttle valve 6 in the intake passage 2. There is provided in the exhaust gas recirculating passage 9 a control valve 10 for controlling the amount of the exhaust gas to be recirculated, which comprises a diaphram actuated by negative intake pressure and an opening which is controlled by a solenoid valve 11.

Further, there is provided a fuel injector 12 for injecting fuel at position downstream of the throttle valve 6 and the fuel injector 12 is communicated with a fuel tank 16 through a fuel feeding passage 15 provided with a fuel pump 13 and a fuel filter 14 therein. A predetermined amount of fuel is fed from the fuel tank 16 to the fuel injector 12 and excess of fuel is recirculated to the fuel tank 16 through a return passage 18 provided with a fuel pressure regulator 17.

Moreover, there are provided an accelerator pedal position sensor 19 for detecting the position level Y of the accelerator pedal 5, that is, the amount of change Y in the position of the accelerator pedal 5 from its zero position, an air flow sensor 20 for detecting the amount of intake air at a position upstream of the throttle valve 6 in the intake passage 2, an intake air temperature sensor 21 for detecting the temperature of the intake air at position upstream of the throttle valve 6, a throttle valve position sensor 22 for detecting the opening X of the throttle valve 6, a cooling water temperature sensor 23 for detecting the temperature of the engine cooling water, an oxygen sensor 24 for detecting the air-fuel ratio of the engine 1 based upon detected concentration of oxygen contained in the exhaust gas at a position upstream of the catalyst device 8 in the exhaust passage 4, a recirculation gas amount sensor 25 provided for the recirculation control valve 10 for detecting the amount of the recirculating gas, and a mode switch 26 for switching driving mode among a power mode for high engine output, a normal mode and a city mode for energy-efficient driving. The mode switch 26 consists of a power mode button **26*a*, a normal mode button 26*b* and a city mode button 26*c* which are manually operated. The signals detected by the sensors 19 to 25 and the mode signal output from the mode switch 26 are input to a control unit 27 comprising a computer unit for controlling the throttle actuator 7, the solenoid valve 11 and the fuel injector 12. Further, the control unit 27 is connected with an ignitor 28 for detecting the number of ignitions in the engine 1 per a unit time and outputting a signal representing the engine r.p.m. to the control unit 27, and with a distributor 29 for outputting ignition timing signals and a battery 30. The control unit 27 controls the amount of fuel to be injected by the fuel injector 12 in accordance with engine operating conditions and the amount of exhaust gas to be recirculated by controlling the solenoid valve 11 ON or OFF to control the opening of the exhaust gas recirculation control valve 10 in accordance with the engine operating condition and, further, the opening X of the throttle valve 6 by controlling the throttle valve actuator 7 in accordance with the engine operating condition and the position Y of the accelerator pedal 5**.

Figure 3:
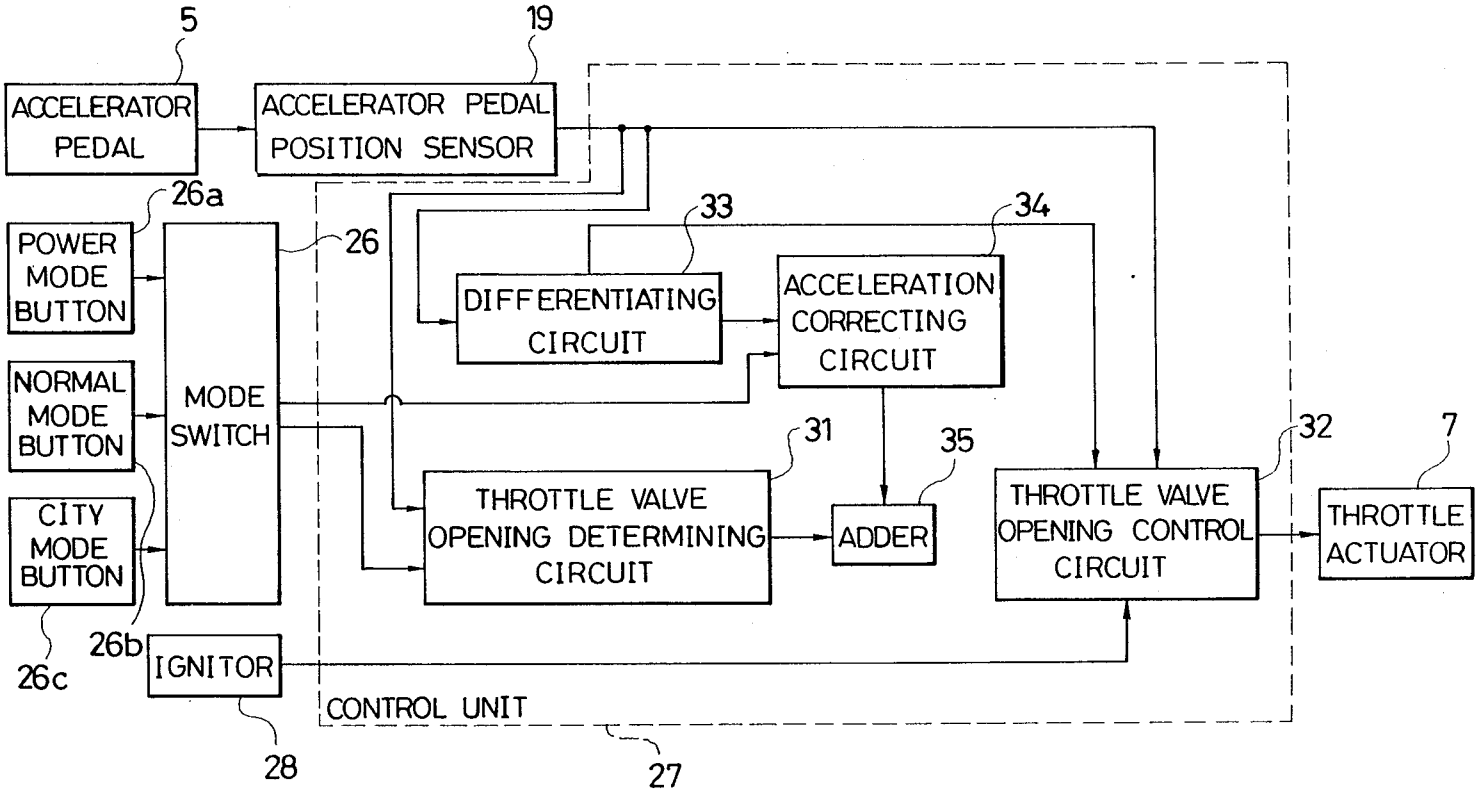
FIG. 3 is a block diagram of a control apparatus for a throttle valve which is an embodiment of the present invention.

Referring to FIG. 3, there are provided in the control unit 27 a throttle valve opening determining circuit 31 for determining a target value Xo of the opening X of the throttle valve 6 in accordance with the signal representing the position Y of the accelerator pedal 5, that is, the amount of change Y in the position of the accelerator pedal 5 from the zero position thereof output from the accelerator pedal position sensor 19 and the driving mode signal output from the mode switch 26 based upon a conversion map experimentally determined for each mode and stored in advance therein, and a throttle valve opening control circuit 32 for outputting a control signal to the throttle actuator 7 to drive the throttle valve so that the opening X of the throttle valve 6 is the target value Xo thereof. Further, in the control unit 27, there are provided a differentiating circuit 33 for differentiating the signal representing the position Y of the accelerator pedal 5 to obtain a rate of change V in the position of the accelerator pedal 5, and an acceleration correcting circuit 34 for judging whether or not the rate of change V in the position of the accelerator pedal 5 for acceleration is larger than a predetermined value and the driving mode is made the power mode in accordance with the output signals from the differentiating circuit 33 and the mode switch 26 and calculating an acceleration correction value Vc so as to increase the engine output in the case where the rate of change V in the position of the accelerator pedal 5 is larger than a predetermined value and the driving mode is made the power mode and outputting the acceleration correction value Vc to an adder 35 in which the acceleration correction value Vc is added to the rate of change V in the position of the accelerator pedal 5. The corrected rate of change V in the position of the accelerator pedal 5 is inputted to the throttle valve opening control circuit 32 to produce control signals for controlling the throttle actuator 7 in accordance with the hereinafter described routine. Thus, it is possible to improve the engine output in a case where a high engine output is required. The throttle valve opening control circuit 32 receives the signal representing the position Y of the accelerator pedal 5 output from the accelerator pedal position sensor 19, a signal representing engine r.p.m. N output from the ignitor 28, the signal representing the rate of change V in the position of the accelerator pedal 5 output from the differentiating circuit 33 and the signal representing the target value Xo of the throttle valve opening output from the adder 35, and corrects the signal representing the target value Xo of the throttle valve opening output from the adder 35 smaller to produce a first control signal for controlling the rate of change in the position of the throttle valve 6 in case where the position Y of the accelerator pedal is larger than a predetermined level, where the rate of change V in the position of the accelerator pedal 5 is larger than a predetermined value and where the engine r.p.m. N is smaller than a predetermined r.p.m., and outputs the first control signal to the throttle actuator 7 and in other cases outputs a second control signal corresponding to the rate of change in the position of the accelerator pedal 5 to the throttle actuator 7 without correcting the signal output from the adder 35.

Figure 4:
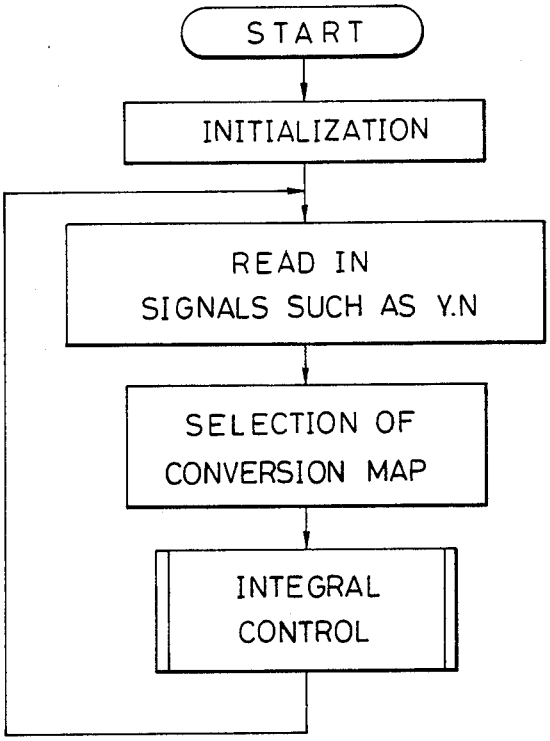
FIG. 4 is a flow chart showing a main routine for controlling the opening of a throttle valve carried out in a control apparatus for a throttle valve which is an embodiment of the present invention.
Figure 5:
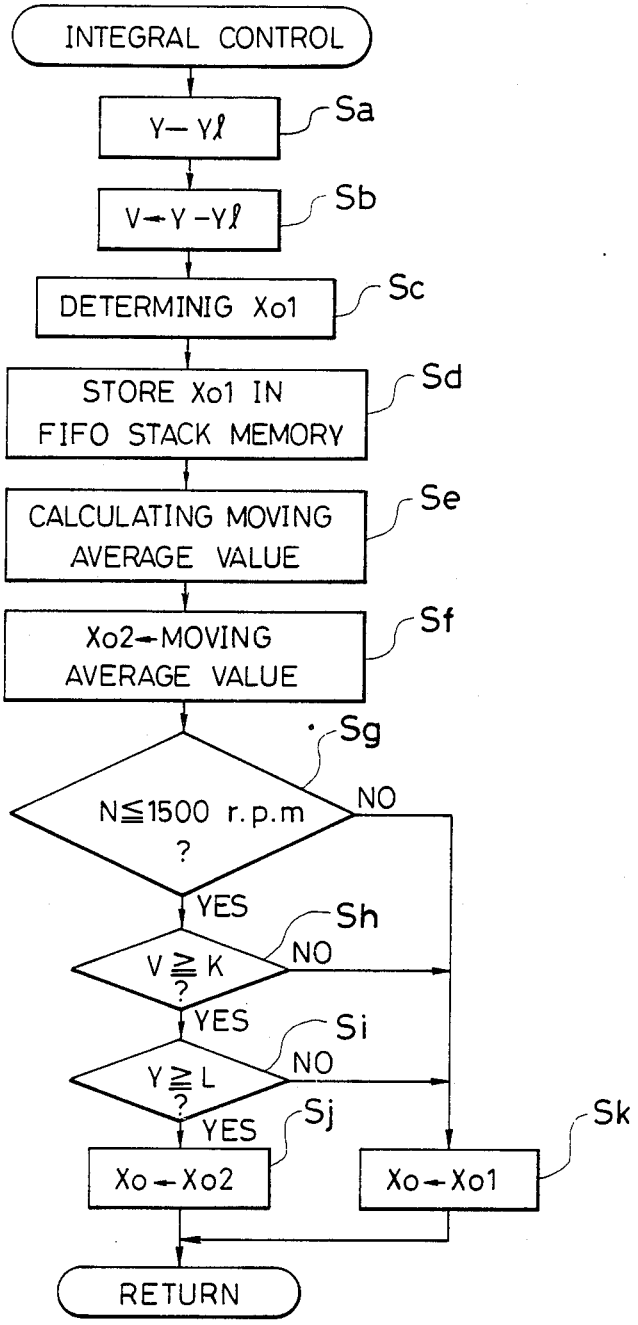
FIG. 5 is a flow chart showing a sub-routine for controlling an opening of a throttle valve carried out in a control apparatus for a throttle valve which is an embodiment of the present invention.

The operation of controlling the opening X of the throttle valve 6 by the control unit 27 is carried out in accordance with the flow charts as shown in FIGS. 4 and 5.

Referring to FIG. 4, there is shown a main routine for the operation. Various kinds of registers and flags etc. are intialized at the first step and then various kinds of signals such as the signal representing the position Y of the accelerator pedal 5, the signal representing the engine r.p.m. N and the mode signal from the mode switch 26 are read in and A/D converted in the second step. Then a map is selected from among the experimentally determined maps for the respective driving modes stored in the throttle valve opening determining circuit 31 for determining the target value Xo of the opening of the throttle valve 6 at the third step. Next in the fourth step, an integral control is carried out so that the opening X of the throttle valve 6 assumes the target value Xo at a predetermined rate. After the operation in the fourth step, the operation in the second step is started again and the operations of the second to fourth steps are repeated.

The integral control is carried out in accordance with a sub-routine as shown in FIG. 5. First in step Sa, the position Y1 of the accelerator pedal 5 read in the preceding time is substracted from the position Y of the accelerator pedal 5 just read in at the second step in the differentiating circuit 33 and the so-obtained value is set as an acceleration differential value V (a rate of change V in the position of the accelerator pedal 5) in the step Sb. Then, at the step Sc, a first target value Xo1 of the opening of the throttle valve 6 is determined in accordance with the position Y of the accelerator pedal 5 just read in at the second step in the throttle valve opening determining circuit 31 and in the step Sd, the so-determined first target value Xo1 is stored in a FIFO stack memory provided for the throttle opening control circuit 32. Subsequently, a moving average value of the first target values Xo1 read in up to that time is calculated in the FIFO stack memory at the step Se and the so-obtained value is set as a second target value Xo2 at the step Sf. Since the second target value Xo2 is a moving average value of the first target values Xo1 up to that time, in the case where the first target value Xo1 increases under acceleration, it is less than the first target value Xo1 calculated at that time.

Further, it is judged in the throttle valve opening control circuit 32 whether or not the engine r.p.m. N is not larger than a predetermined r.p.m. such as 1500 r.p.m. at the step Sg and the acceleration differential value V (the rate of change V in the position of the accelerator pedal 5) is not less than a predetermined value K at the step Sh and the position Y of the accelerator pedal 5 is not less than a predetermined level L at the step Si. As a result, in the case where the engine r.p.m. N is not larger than a predetermined value such as 1500 and the acceleration differential value V (the rate of change V in the position of the accelerator pedal 5) is not less than a predetermined value K and the position level Y of the accelerator pedal 5 is not less than a predetermined level L, the second target value Xo2 is output as a final target value Xo in the step Sj. To the contrary, in the case where the engine r.p.m. N is larger than a predetermined value such as 1500 or the acceleration differential value V (the rate of change V in the position of the accelerator pedal 5) is less than a predetermined value K or the position Y of the accelerator pedal 5 is less than a predetermined level L, the first target value Xo1 is output as a final target value Xo in the step Sj. Thus, under the condition where the engine r.p.m. N is low and where the position Y of the accelerator pedal 5 is larger than the predetermined level and where the rate of change V thereof is larger than the predetermined value, the target value Xo of the opening of the throttle valve 6 is set to be a smaller value Xo2 and output to the throttle actuator 7 and, therefore, the throttle valve 6 is driven at a relatively small rate under such driving condition. On the other hand, under the condition where the engine r.p.m. N is not low, or where the rate of change V in the position of the accelerator pedal 5 is less than the predetermined value K even if the the engine r.p.m. N is low or where the position Y of the accelerator pedal 5 is less than the predetermined level L even if the engine r.p.m. N is low and the rate of change V in the position of the accelerator pedal 5 is not less than the predetermined value K, the target value Xo is set to be larger value Xo1 and is output to the throttle actuator 7 and, therefore, the throttle valve 6 is driven at a relatively high.

Figure 6:
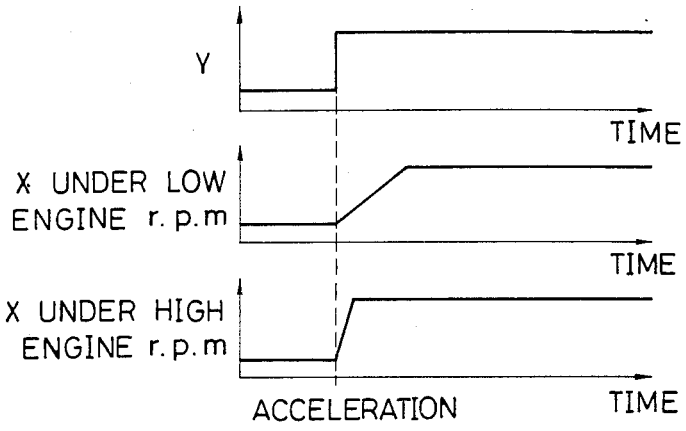
FIG. 6 is a graph showing a relationship between the amount of change in position of an accelerator pedal and the opening of a throttle valve to be controlled in accordance therewith in a control apparatus for a throttle valve which is an embodiment of the present invention.

According to the above described embodiment, since the driving rate of the throttle valve 6 is controlled to be relatively low by the throttle opening control circuit 32 under low engine r.p.m. as shown in FIG. 6, sudden changes in the amount of intake air and the engine load are suppressed and the air-fuel ratio is prevented from becoming expressively lean and the ignition timing is prevented from advancing too much. As a result, knocking is effectively prevented without degrading the response of the engine to operation of the accelerator pedal 5.

On the other hand, since the throttle valve 6 is moved quickly to the target position under the high engine r.p.m. and its opening immediately assumes the target value Xo, it is possible to promptly respond to the operation of the accelerator pedal 5.

Further, since the throttle valve 6 is quickly driven to the target position in a similar manner to the operation under the high engine r.p.m. in the case where the position Y the accelerator pedal 5 is smaller than the predetermined level, even if the engine r.p.m. is low, the response of the engine to operation of the accelerator pedal 5 can be remarkably improved.

Figure 7:
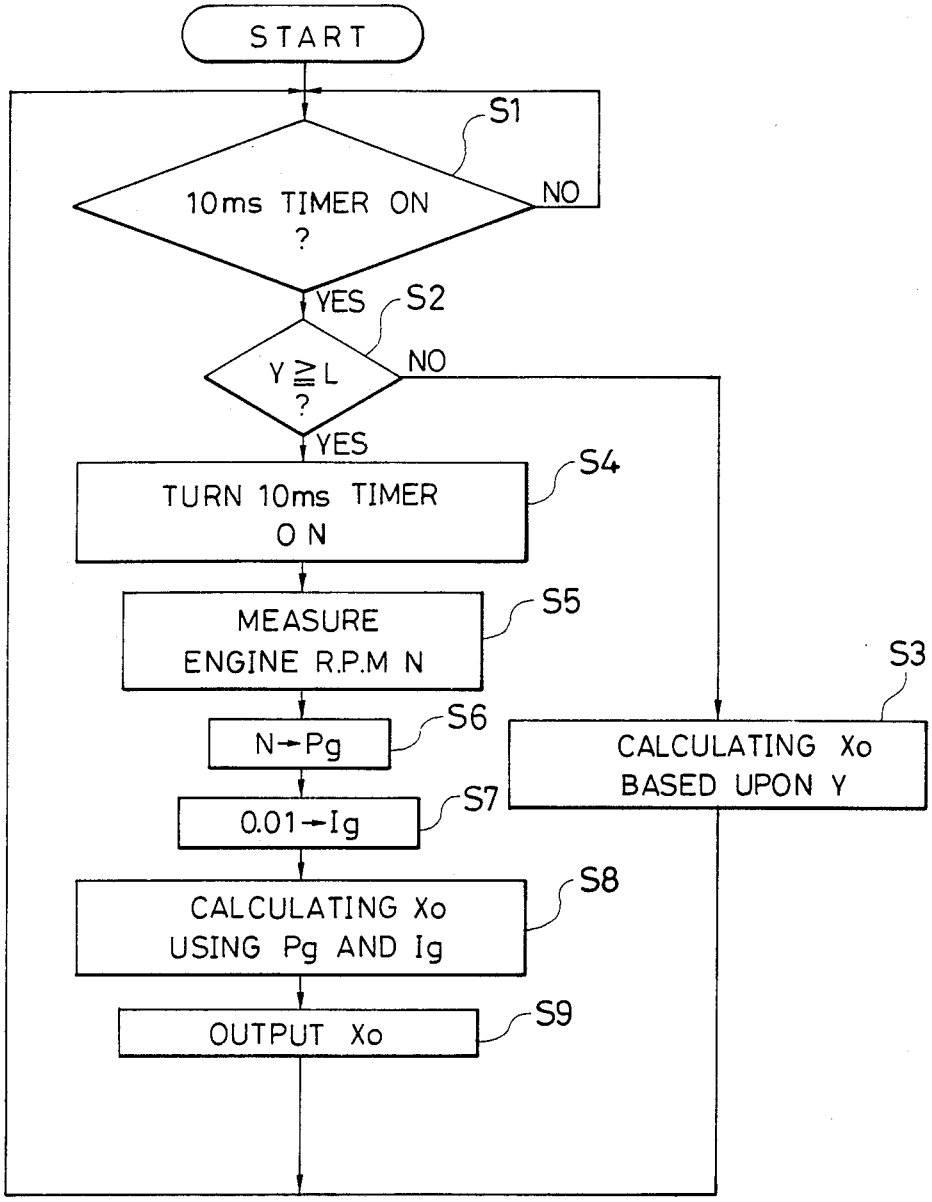
FIG. 7 is a flow chart showing an operation for controlling the opening of a throttle valve in a control apparatus for a throttle valve which is another embodiment of the present invention.

FIG. 7 is a flow chart showing a method for controlling the opening X of the throttle valve 6 in a control system for a throttle valve which is another embodiment of the present invention. In the flow chart shown in FIG. 7, the opening X of the throttle valve 6 is controlled by a proportional plus integral control in which a proportional gain is changed in accordance with engine r.p.m.

Figure 8:
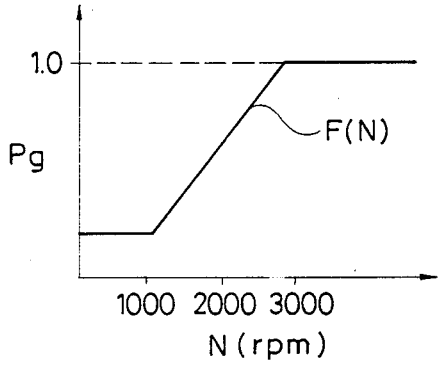
FIG. 8 is a graph showing a relationship between engine r.p.m. and a proportional gain used for controlling the opening of a throttle valve in a control apparatus for a throttle valve which is another embodiment of the present invention.

Referring to FIG. 7, after it is judged that a 10 ms timer is ON at the step S1, the following operation is started. In other words, one cycle of the following operation is carried out every 10 ms. Firstly it is judged at the step S2 whether the position Y of the accelerator pedal 5 is not less than the predetermined level L. As a result, if the position Y of the accelerator pedal 5 is less than the predetermined level L, the target value Xo of the opening of throttle valve is determined in accordance with the position Y of the accelerator pedal 5 based upon the map stored in the throttle valve opening control circuit 32 at the step S3. To the contrary, in case where the position Y of the accelerator pedal 5 is not less than the predetermined level L, that is, under a normal acceleration, the timer of 10 ms is turned ON at the step S4 and then the engine r.p.m. N at that time is measured by the ignitor 28 at the step S5. Subsequently a proportional gain Pg is determined in accordance with the measured engine r.p.m. N based upon an experimentally determined characteristic curve F shown in FIG. 8. According to the characteristic curve F shown in FIG. 8, the proportional Pg gain is small under low engine r.p.m. and increases as the engine r.p.m. increases, and it is determined to be 1.0 under a condition where the engine r.p.m. is larger than a predetermined value and where the throttle valve 6 is fully opened.

Then an integral gain Ig is set to a predetermined value such as 0.01 at the step S7 and afterward a target value Xo of the opening of the throttle valve 6 is calculated based upon the proportional gain Pg and the integral gain Ig at the step S8. More specifically, the target value Xo is calculated by adding a value obtained by multiplying the position Y of the accelerator pedal 5 by the proportional gain Pg and a value obtained by multiplying the integral gain Ig by a value obtained by adding a value obtained by substracting the target value Xo calculated the preceding time from the amount of change Y in the position of the accelerator pedal 5. The so-obtained target value Xo of the opening of the throttle valve 6 is output to the throttle actuator 7 as a target value Xo after the next cycle is completed. The above described operations are repeated.

Figure 9A:
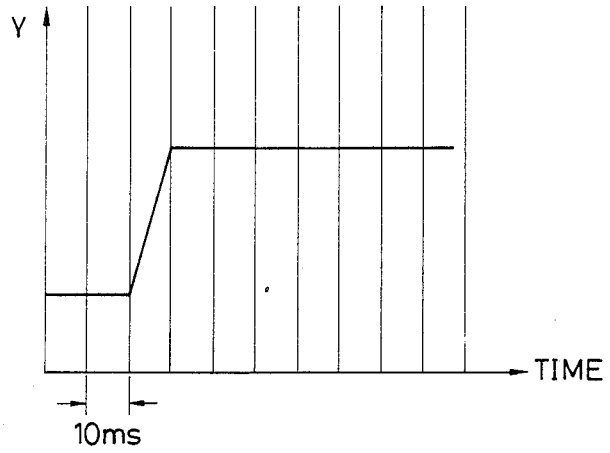
FIG. 9 is a graph showing the operation of a control apparatus for a throttle valve which is another embodiment of the present invention under a rapid acceleration.
Figure 9B:
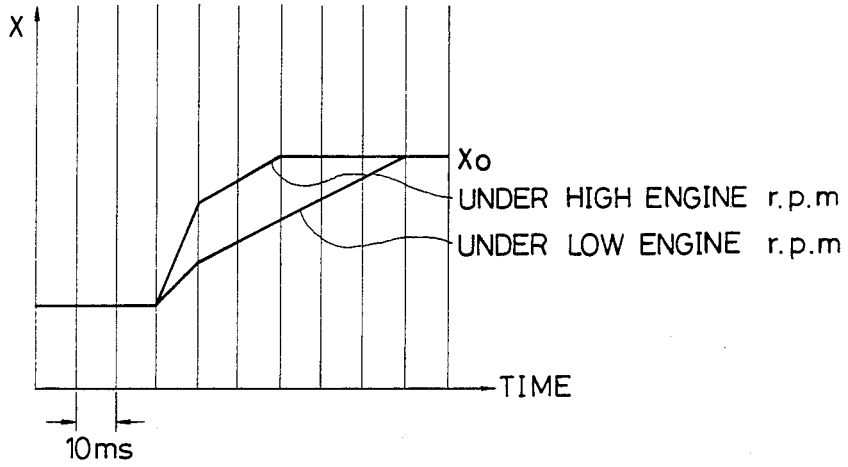

According to the above described embodiment, as shown in FIG. 9, since the proportional gain Pg is determined to be a small value under the low engine r.p.m. and a large value under high engine r.p.m., the rate of change in the throttle valve opening under low engine r.p.m. is initially smaller than that under high engine r.p.m. and then becomes identical with that under high engine r.p.m.. Therefore, knocking can be effectively prevented under low engine r.p.m.. Further, since the throttle valve 6 is driven at a rate corresponding to the position Y of the accelerator pedal 5 in case where the position Y of the accelerator pedal 5 is low, it is possible to improve the response of the engine to acceleration when the accelerator pedal 5 is slightly operated.

Although the rate of change in the throttle valve opening is controlled by the position Y of the accelerator pedal 5, that is, the amount of change in the position of the accelerator pedal 5 from its zero position in the above described embodiments, it is possible instead to control the rate of change in the throttle valve opening in accordance with the amount of change in the position of the accelerator pedal 5 from its most recent position, and in such case, the same technical advantages as those described above can be obtained.

As described above, according to the present invention, the response of the engine to acceleration under high engine r.p.m. can be remarkably improved and knocking can be effectively prevented under low engine r.p.m. without degrading the response of the engine to acceleration when an accelerator pedal is slightly operated.

The present invention has thus been shown and described with reference to specific embodiments. However, it should be noted that the present invention is in no way limited to the details of the described arrangements but changes and modifications may be made without departing from the scope of the appended claims.

What is claimed is:

1. An internal combustion engine throttle valve control system comprising driving means for driving a throttle valve so that the opening of the throttle valve assumes a predetermined value in accordance with the amount of change in the position of an accelerator pedal, engine r.p.m. detecting means for detecting engine r.p.m. and outputting a signal representing the detected engine r.p.m., and control means for controlling the rate of driving the throttle valve which receive said signal output from said engine r.p.m. detecting means and which produces, in accordance with the rate of change in the position of the accelerator pedal, a first signal to drive the throttle valve at a first rate corresponding to the rate of change in the position of the accelerator pedal under a condition where the amount of change in the position of the accelerator pedal is not larger than a predetermined value and a second signal to drive the throttle valve at a second rate smaller than the first rate under the condition where the amount of change in the position of the accelerator pedal is larger than the predetermined value and where the rate of change in the position of the accelerator pedal is larger than a predetermined value and where the engine r.p.m. is smaller than a predetermined value and controls said driving means in accordance with the engine operating condition.

2. An internal combustion engine throttle valve control system in accordance with claim 1 in which said driving means electrically drives said throttle valve.

3. An internal combustion engine throttle valve control system in accordance with claim 1 in which said control means produces said first and second signals in accordance with the engine operating conditions in case where the position of said accelerator pedal is changed for acceleration and produces only said second signal under any engine operating conditions in a case where the position of said accelerator pedal is changed to decelerate.

4. An internal combustion engine throttle valve control system in accordance with claim 1 in which said internal combustion engine is provided with a fuel injecting means.

5. An internal combustion engine throttle valve control system comprising accelerator pedal operation detecting means for detecting the amount of change in the position of an accelerator pedal and outputting a signal based upon said detected amount of change in the position of the accelerator pedal, throttle valve opening determining means for receiving said signal output from said accelerator operation decting means and determining an opening of the throttle valve corresponding the amount of change in the position of the accelerator pedal based upon said received signal and outputting a signal representing said opening of the throttle valve, driving means for receiving said signal outputted from said throttle valve opening determining means and driving the throttle valve so that its opening becomes said determined opening value, engine r.p.m. detecting means for detecting engine r.p.m. and outputting a signal based upon said detected engine r.p.m., acceleration pedal operation rate detecting means for detecting the rate of change in the position of the accelerator pedal for acceleration and outputting a signal based upon the detected rate of change in the position of the accelerator pedal, and control means for controlling the rate of driving the throttle valve which receive said signal output from said engine r.p.m. detecting means and which produces, in accordance with the rate of change in the position of the accelerator pedal, a first signal to drive the throttle valve at a first rate corresponding to the rate of change in the position of the accelerator pedal under a condition where the amount of change in the position of the accelerator pedal is not larger than a predetermined value and a second signal to drive the throttle valve at a second rate smaller than the first rate under the condition where the amount of change in the position of the accelerator pedal is larger than the predetermined value and where the rate of change in the position of the accelerator pedal is larger than a predetermined value and where the engine r.p.m. is smaller than a predetermined value and controls said driving means in accordance with the engine operating condition.

6. An internal combustion throttle valve control system in accordance with claim 5 in which said control means produces, in accordance with a rate of change in the position of the accelerator pedal, a first signal to drive the throttle valve at a first rate corresponding to the rate of change in the position of the accelerator pedal under a condition other than those where the amount of change in the position of the accelerator pedal is larger than the predetermined value and where the rate of change in the position of the accelerator pedal is larger than a predetermined value and where the engine r.p.m. is smaller than a predetermined value.

7. An internal combustion throttle valve control system in accordance with claim 5 in which said second rate is determined by correcting to a small value a target value of the throttle valve opening obtained in accordance with the amount of change in the position of the accelerator pedal and is controlled so that said correcting value decreases gradually and becomes zero after a predetermined time.

8. An internal combustion engine throttle valve control system in accordance with claim 5 in which said second rate is determined to be proportional to the engine r.p.m..

9. An internal combustion engine throttle valve control system in accordance with claim 5 in which said second rate is determined by setting a target value of the throttle valve opening to be an average value of a target value thereof obtained in accordance with the amount of change in the position of the accelerator pedal before and after an acceleration operation.

10. An internal combustion engine throttle valve control system comprising accelerator pedal operation detecting means for detecting the amount of change in the position of an accelerator pedal and outputting a signal based upon said detected amount of change in the position of the accelerator pedal, throttle valve opening determining means for receiving said signal output from said accelerator pedal operation detecting means and determining an opening of the throttle valve corresponding the amount of change in the position of the accelerator pedal based upon said received signal and outputting a signal representing said opening of the throttle valve, driving means for receiving said signal output from said throttle valve opening determining means and driving the throttle valve so that its opening assumes said determined opening value, engine r.p.m. detecting means for detecting engine r.p.m. and outputting a signal representing said detected engine r.p.m., accelerator pedal operation rate detecting means for detecting the rate of change in the position of the accelerator pedal for acceleration and outputting a signal based upon the detected rate of change in the position of the accelerator pedal, and control means for controlling a rate of driving the throttle valve which receives said signal output from said engine r.p.m. detecting means and which produces a first signal to drive the throttle valve at a first rate corresponding to the rate of change in the position of the accelerator pedal under a condition where the amount of change in the position of the accelerator pedal is not larger than a predetermined value and, under the condition where the amount of change in the position of the accelerator pedal is larger than the predetermined value, a second signal to drive the throttle valve at a second rate which is not larger than the first rate and which is determined in accordance with the engine r.p.m. to be smaller in proportion as the engine r.p.m. is lower, and outputs either the first or second signal to said driving means in accordance with the engine operating conditions.

11. An internal combustion engine throttle valve control system in accordance with claim 10 in which said second rate is determined so that it is constant after the throttle valve opening becomes a predetermined value regardless of the engine r.p.m.

* * * * *